US008069529B2

(12) United States Patent
Groff et al.

(10) Patent No.: US 8,069,529 B2
(45) Date of Patent: Dec. 6, 2011

(54) HANDHELD VACUUM CLEANER

(75) Inventors: Timothy Groff, Mentor, OH (US); Greg Pajak, Lakewood, OH (US); Jack W. Gee, II, Willoughby, OH (US); Andrew Chick, Norfolk, MA (US); David Khalil, Highland Heights, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 136 days.

(21) Appl. No.: 12/603,294

(22) Filed: Oct. 21, 2009

(65) Prior Publication Data

US 2010/0115726 A1 May 13, 2010

Related U.S. Application Data

(60) Provisional application No. 61/107,553, filed on Oct. 22, 2008.

(51) Int. Cl.
*A47L 5/24* (2006.01)

(52) U.S. Cl. ..... 15/344; 15/347

(58) Field of Classification Search ..... 15/344, 15/347, 351, 353, 328, 329, 331, 323
See application file for complete search history.

(56) References Cited

U.S. PATENT DOCUMENTS

| | | | |
|---|---|---|---|
| 1,861,261 | A | 5/1932 | Carson |
| 2,668,318 | A | 2/1954 | Le Bon, Ill |
| 2,972,160 | A | 2/1961 | Hahn |
| 3,397,517 | A | 8/1968 | Vigan |
| 3,477,087 | A | 11/1969 | Robinson |
| 3,513,500 | A | 5/1970 | Hori |
| 3,596,443 | A | 8/1971 | Goldberg |
| 3,695,006 | A | 10/1972 | Valbona et al. |
| 3,898,414 | A | 8/1975 | Hawley |
| 3,998,656 | A | 12/1976 | Grotto |
| 4,011,624 | A | 3/1977 | Proett |

(Continued)

FOREIGN PATENT DOCUMENTS

EP 0268067 5/1988

(Continued)

OTHER PUBLICATIONS

Dirt Devil, Owner's Manual, Operating and Servicing Instructions, #1-113210-000, 2005.

(Continued)

*Primary Examiner* — Dung Van Nguyen
(74) *Attorney, Agent, or Firm* — Michael Best & Friedrich LLP

(57) ABSTRACT

A handheld vacuum cleaner including an inlet, an outlet, and a dust cup having an aperture. The dust cup is in fluid communication with the inlet and the outlet and is configured to retain debris collected by the handheld vacuum cleaner. A fan is configured to draw air through the inlet and the dust cup and to discharge air through the outlet. A door is adjacent to the dust cup and includes the inlet. The door is movable between an open position to allow a user to empty the debris collected within the dust cup through the aperture of the dust cup and a closed position to inhibit debris from being emptied through the aperture of the dust cup and to allow debris to be collected through the inlet and through the aperture of the dust cup. A biasing member configured to bias the door toward the open position.

16 Claims, 11 Drawing Sheets

U.S. PATENT DOCUMENTS

| | | | | |
|---|---|---|---|---|
| 4,175,352 | A | | 11/1979 | Catlett |
| 4,209,875 | A | | 7/1980 | Pugh et al. |
| 4,224,044 | A | | 9/1980 | King |
| 4,380,845 | A | | 4/1983 | Miller et al. |
| 4,388,087 | A | | 6/1983 | Tipton |
| 4,508,550 | A | | 4/1985 | Berfield et al. |
| 4,547,206 | A | | 10/1985 | Sovis et al. |
| 4,557,738 | A | | 12/1985 | Menasian |
| 4,565,555 | A | | 1/1986 | Menasian |
| 4,573,237 | A | | 3/1986 | Kochte et al. |
| 4,610,048 | A | | 9/1986 | Ishihara et al. |
| 4,633,543 | A | | 1/1987 | Sovis et al. |
| 4,642,841 | A | | 2/1987 | Berfield et al. |
| 4,656,687 | A | | 4/1987 | Wei |
| 4,682,384 | A | | 7/1987 | Prahl et al. |
| 4,730,362 | A | | 3/1988 | Sovis et al. |
| 4,741,070 | A | | 5/1988 | Sovis et al. |
| 4,745,654 | A | * | 5/1988 | Yamamoto et al. ..... 15/344 |
| 4,788,740 | A | | 12/1988 | Sovis et al. |
| 4,791,699 | A | | 12/1988 | Sovis et al. |
| 4,798,613 | A | | 1/1989 | Hetherington et al. |
| 4,800,614 | A | | 1/1989 | Kopco et al. |
| 4,821,366 | A | | 4/1989 | Levine |
| 4,850,076 | A | | 7/1989 | Ostroski et al. |
| 4,870,714 | A | | 10/1989 | Miner |
| 4,891,861 | A | | 1/1990 | Sovis et al. |
| 4,894,882 | A | | 1/1990 | Toya |
| 4,899,418 | A | | 2/1990 | Steiner et al. |
| 4,904,126 | A | | 2/1990 | Voith |
| 4,918,781 | A | | 4/1990 | Sovis et al. |
| 4,924,548 | A | | 5/1990 | Touya et al. |
| 4,928,346 | A | | 5/1990 | Elson et al. |
| 4,930,178 | A | | 6/1990 | Monson et al. |
| 4,939,810 | A | | 7/1990 | Ataka |
| 4,967,443 | A | | 11/1990 | Krasznai et al. |
| 4,993,108 | A | | 2/1991 | Genge et al. |
| 5,020,187 | A | | 6/1991 | Kosten et al. |
| 5,025,529 | A | | 6/1991 | Hult et al. |
| 5,029,359 | A | | 7/1991 | Ortega |
| 5,056,187 | A | | 10/1991 | Higgins |
| 5,065,473 | A | | 11/1991 | Krasznai et al. |
| 5,078,761 | A | | 1/1992 | Dyson |
| 5,129,128 | A | | 7/1992 | Bowerman et al. |
| 5,289,610 | A | | 3/1994 | Monson |
| 5,331,716 | A | | 7/1994 | Hemmann et al. |
| 5,337,443 | A | | 8/1994 | Steinberg et al. |
| 5,341,541 | A | | 8/1994 | Sham |
| 5,367,740 | A | | 11/1994 | McCray |
| 5,392,490 | A | | 2/1995 | Monson |
| 5,421,058 | A | | 6/1995 | Zahuranec et al. |
| 5,500,978 | A | | 3/1996 | Levine |
| 5,504,970 | A | | 4/1996 | Neshat et al. |
| 5,561,885 | A | | 10/1996 | Zahuranec et al. |
| 5,586,358 | A | | 12/1996 | Wolfe et al. |
| 5,599,401 | A | | 2/1997 | Brosky et al. |
| 5,652,996 | A | | 8/1997 | Moine et al. |
| 5,659,922 | A | | 8/1997 | Louis |
| 5,664,282 | A | | 9/1997 | Castwall et al. |
| 5,711,775 | A | | 1/1998 | Field et al. |
| 5,733,351 | A | | 3/1998 | Hult et al. |
| 5,735,010 | A | | 4/1998 | Burner et al. |
| 5,783,086 | A | | 7/1998 | Scanlon et al. |
| 5,829,094 | A | | 11/1998 | Field et al. |
| 5,938,410 | A | | 8/1999 | Lee |
| 5,966,774 | A | | 10/1999 | Bone et al. |
| 5,970,572 | A | | 10/1999 | Thomas |
| 6,003,196 | A | | 12/1999 | Wright et al. |
| 6,012,200 | A | | 1/2000 | Murphy et al. |
| 6,024,678 | A | | 2/2000 | Solomon |
| 6,026,540 | A | | 2/2000 | Wright et al. |
| 6,031,969 | A | | 2/2000 | Burr et al. |
| 6,052,864 | A | | 4/2000 | Ho |
| 6,066,211 | A | | 5/2000 | Sandell |
| 6,070,291 | A | | 6/2000 | Bair et al. |
| 6,081,961 | A | | 7/2000 | Wang |
| 6,117,200 | A | | 9/2000 | Berg et al. |
| 6,231,647 | B1 | | 5/2001 | Cheng |
| 6,260,234 | B1 | | 7/2001 | Wright et al. |
| 6,264,727 | B1 | | 7/2001 | Elmore |
| 6,341,404 | B1 | | 1/2002 | Salo et al. |
| 6,347,428 | B1 | | 2/2002 | Shimko et al. |
| 6,353,963 | B1 | | 3/2002 | Bair et al. |
| 6,401,295 | B2 | | 6/2002 | Bair et al. |
| 6,735,817 | B2 | | 5/2004 | Bair et al. |
| 6,835,222 | B2 | | 12/2004 | Gammack |
| 6,839,934 | B2 | | 1/2005 | Houghton et al. |
| 6,974,488 | B2 | | 12/2005 | Dyson |
| 6,991,666 | B2 | | 1/2006 | Organ |
| 7,018,439 | B2 | | 3/2006 | Vuijk |
| 7,278,181 | B2 | | 10/2007 | Harris et al. |
| 7,291,190 | B2 | | 11/2007 | Dummelow et al. |
| 7,386,916 | B2 | | 6/2008 | Bone |
| 7,618,470 | B2 | | 11/2009 | Eddington et al. |
| 7,637,991 | B2 | | 12/2009 | Eddington et al. |
| 7,669,281 | B2 | | 3/2010 | Fukuda et al. |
| 7,882,593 | B2 | * | 2/2011 | Beskow et al. ..... 15/353 |
| 7,958,597 | B2 | * | 6/2011 | Frantzen et al. ..... 15/344 |
| 2006/0156508 | A1 | | 7/2006 | Khalil |

FOREIGN PATENT DOCUMENTS

| | | |
|---|---|---|
| EP | 0297526 | 1/1989 |
| EP | 0338479 | 10/1989 |
| EP | 0365707 | 5/1990 |
| EP | 0489565 | 6/1992 |
| EP | 0625330 | 11/1994 |
| EP | 0636337 | 2/1995 |
| EP | 0914795 | 5/1999 |
| EP | 0970652 | 1/2000 |
| JP | 8038402 | 2/1996 |
| JP | 8038406 | 2/1996 |
| JP | 8071338 | 3/1996 |
| JP | 8191783 | 7/1996 |
| JP | 9038355 | 2/1997 |
| JP | 9047407 | 2/1997 |
| JP | 9256337 | 9/1997 |
| JP | 10005158 | 1/1998 |
| JP | 10014833 | 1/1998 |
| JP | 10193186 | 7/1998 |
| JP | 11056717 | 3/1999 |
| JP | 11089768 | 4/1999 |
| JP | 11192194 | 7/1999 |
| JP | 11206652 | 8/1999 |
| JP | 2000041909 | 2/2000 |
| JP | 2000041917 | 2/2000 |
| JP | 2000107103 | 4/2000 |
| JP | 2000152898 | 6/2000 |
| JP | 2000152899 | 6/2000 |
| JP | 2000245660 | 9/2000 |
| JP | 2006034720 | 2/2006 |
| JP | 2007029231 | 2/2007 |

OTHER PUBLICATIONS

Amazon.com, Shark SV736K 15.6-Volt Cordless Handheld Vacuum Cleaner with Motorized Brush, Colors Vary, available online at: <http://www.amazon.com/SV736N-15-6-Volt-Cordless-Handheld-Motorized/dp/B0009RF81A/ref=sr__1__2?ie=UTF8&s=home-garden&qid=1267464155&sr=8-2>, at least as early as Sep. 10, 2009.

Amazon.com, Black & Decker HV9010P Retriever Pet-Series Cyclonic-Action Corded Dustbuster and Blower, available online at: <http://www.amazon.com/Black-Decker-HV9010P-Cyclonic-Action-Dustbuster/dp/B000NCS0DE/ref=sr__1__1?ie=UTF8&s=home-garden&qid=1267464662&sr=8-1>, at least as early as Sep. 10, 2009.

PCT/US2009/061508 International Search Report and Written Opinion dated May 19, 2010 (10 pages).

* cited by examiner

HANDHELD VACUUM CLEANER

CROSS-REFERENCE TO RELATED APPLICATIONS

This application claims priority to U.S. Provisional Patent Application 61/107,553, filed Oct. 22, 2008, the entire contents of which are hereby incorporated by reference herein.

BACKGROUND

The present invention relates to handheld vacuum cleaners.

Portable handheld vacuum cleaners can be used to clean a variety of surfaces in homes, offices, cars, and the like. Such handheld vacuum cleaners are often used for relatively small cleaning jobs or for cleaning in hard-to-reach places. Also, these vacuum cleaners are relatively light and have a handle to enable a user to readily use the vacuum cleaner in places where canister, upright, or shop-type vacuum cleaners cannot be used or are inconvenient to use. Often, such handheld vacuum cleaners are battery powered.

SUMMARY

In one embodiment, the invention provides a handheld vacuum cleaner including an inlet, an outlet, and a dust cup having an aperture. The dust cup is in fluid communication with the inlet and the outlet and is configured to retain debris collected by the handheld vacuum cleaner. A fan is configured to draw air through the inlet and the dust cup and to discharge air through the outlet. A door is adjacent to the dust cup and includes the inlet. The door is movable between an open position to allow a user to empty the debris collected within the dust cup through the aperture of the dust cup and a closed position to inhibit debris from being emptied through the aperture of the dust cup and to allow debris to be collected through the inlet and through the aperture of the dust cup. A biasing member is configured to bias the door toward the open position.

In another embodiment the invention provides a handheld vacuum cleaner including an inlet, an outlet, and a dust cup in fluid communication with the inlet and the outlet and configured to retain debris collected by the handheld vacuum cleaner. A fan is configured to draw air through the inlet and the dust cup and discharge air through the outlet. A telescoping nozzle is coupled to the dust cup and the telescoping nozzle defines the inlet. An accessory tool is removably coupled to the telescoping nozzle, and the accessory tool includes an outlet conduit received within the telescoping nozzle. The telescoping nozzle is movably coupled to the dust cup such that the telescoping nozzle is movable from a recessed position where the telescoping nozzle is substantially retained within the dust cup to an extended position where the telescoping nozzle extends from the dust cup to position the inlet further from the dust cup.

Other aspects of the invention will become apparent by consideration of the Detailed Description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
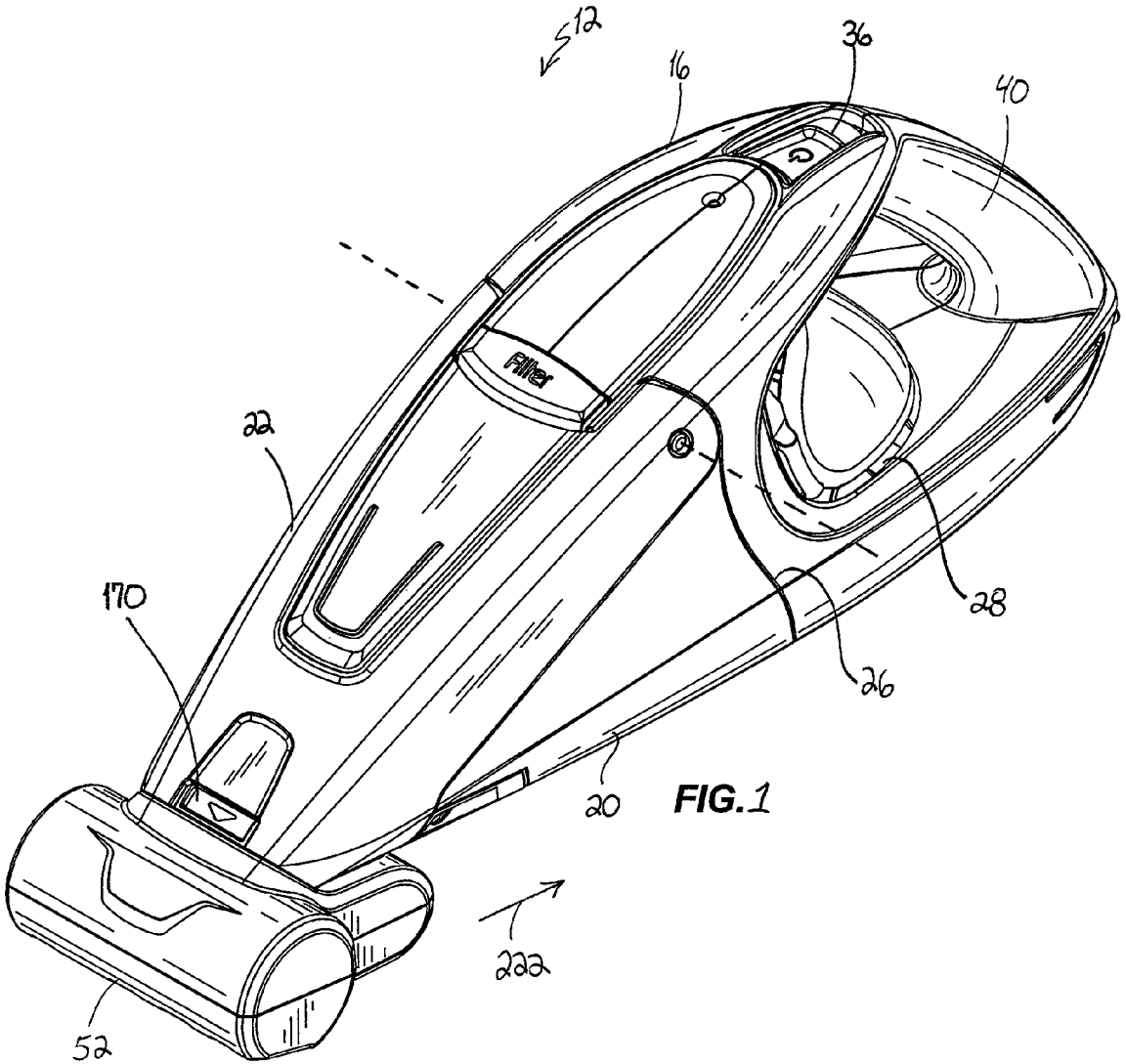
FIG. 1 is a perspective view of a handheld vacuum cleaner according to one embodiment of the invention.

FIG. 1 illustrates a portable handheld vacuum cleaner 12. The vacuum cleaner 12 includes a main or fan housing 16 coupled to a dust or dirt cup 20 and a door 22 coupled to the dust cup 20 for emptying debris collected in the dust cup 20. The fan housing 16 includes an air inlet 24 (FIG. 2) at a front end 26 of the housing 16 and an air outlet 28 behind the air inlet 24. A fan 32 (FIG. 3) is disposed within the fan housing 16; the fan 32 is operable to draw air through the inlet 24 and to discharge air though the outlet 28. The housing 16 further includes a motor configured to drive the fan 32. In one embodiment, the motor is a direct current (DC) motor powered by a rechargeable battery that is also located within the fan housing 16. In other embodiments, the fan 32 can be driven by an alternating current (AC) motor that does not require the rechargeable battery. A switch 36 is located on the housing 16 adjacent a main handle 40 of the vacuum cleaner 12. In the illustrated embodiment, the switch 36 is slid between 'on' and 'off' positions, typically with the user's thumb, to turn the fan 32 'on' and 'off', and therefore the vacuum cleaner 12 'on' and 'off.'

Figure 2:
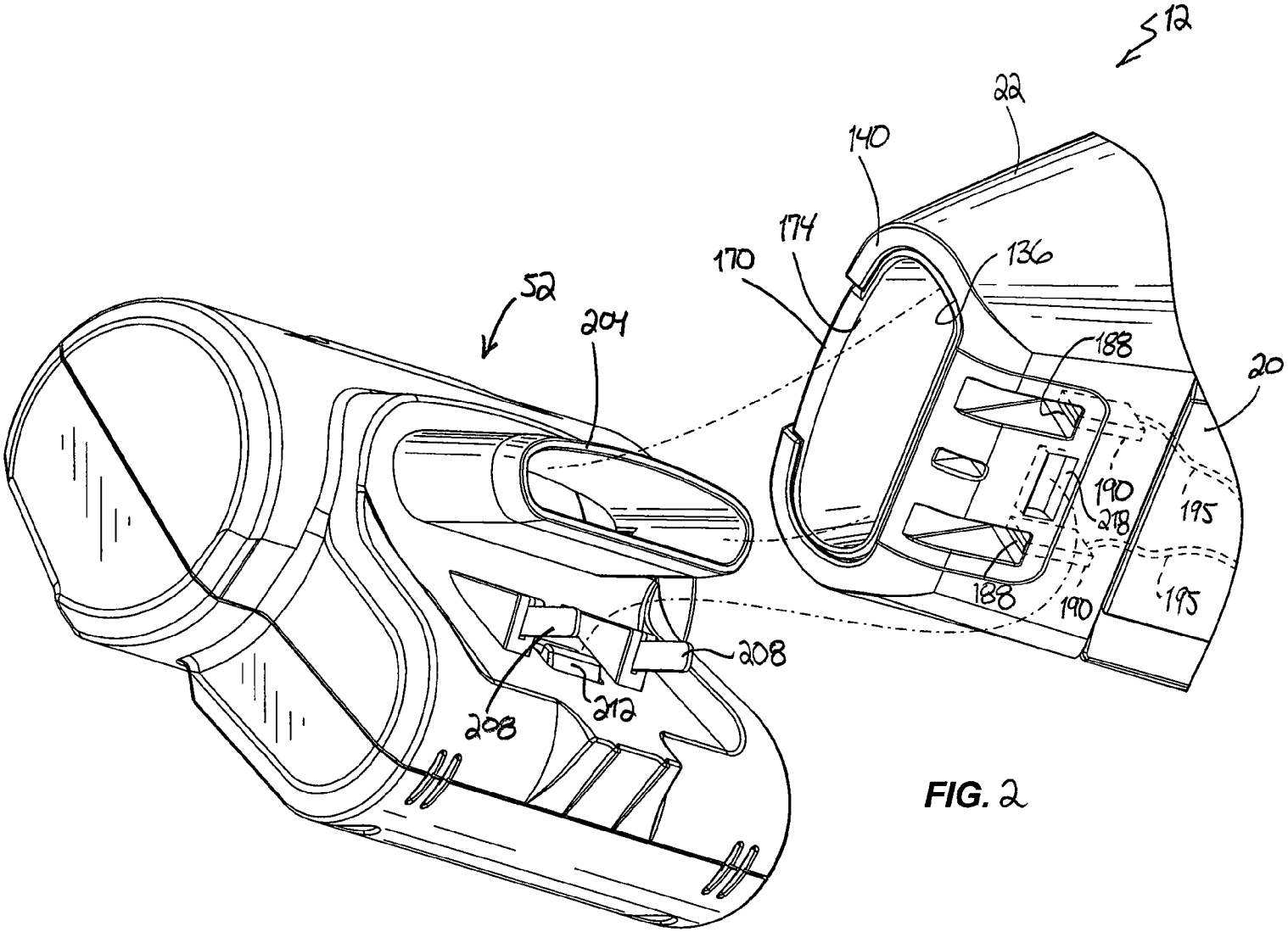
FIG. 2 is an enlarged perspective view of the vacuum cleaner of FIG. 1 illustrating an accessory tool being removed.
Figure 3:
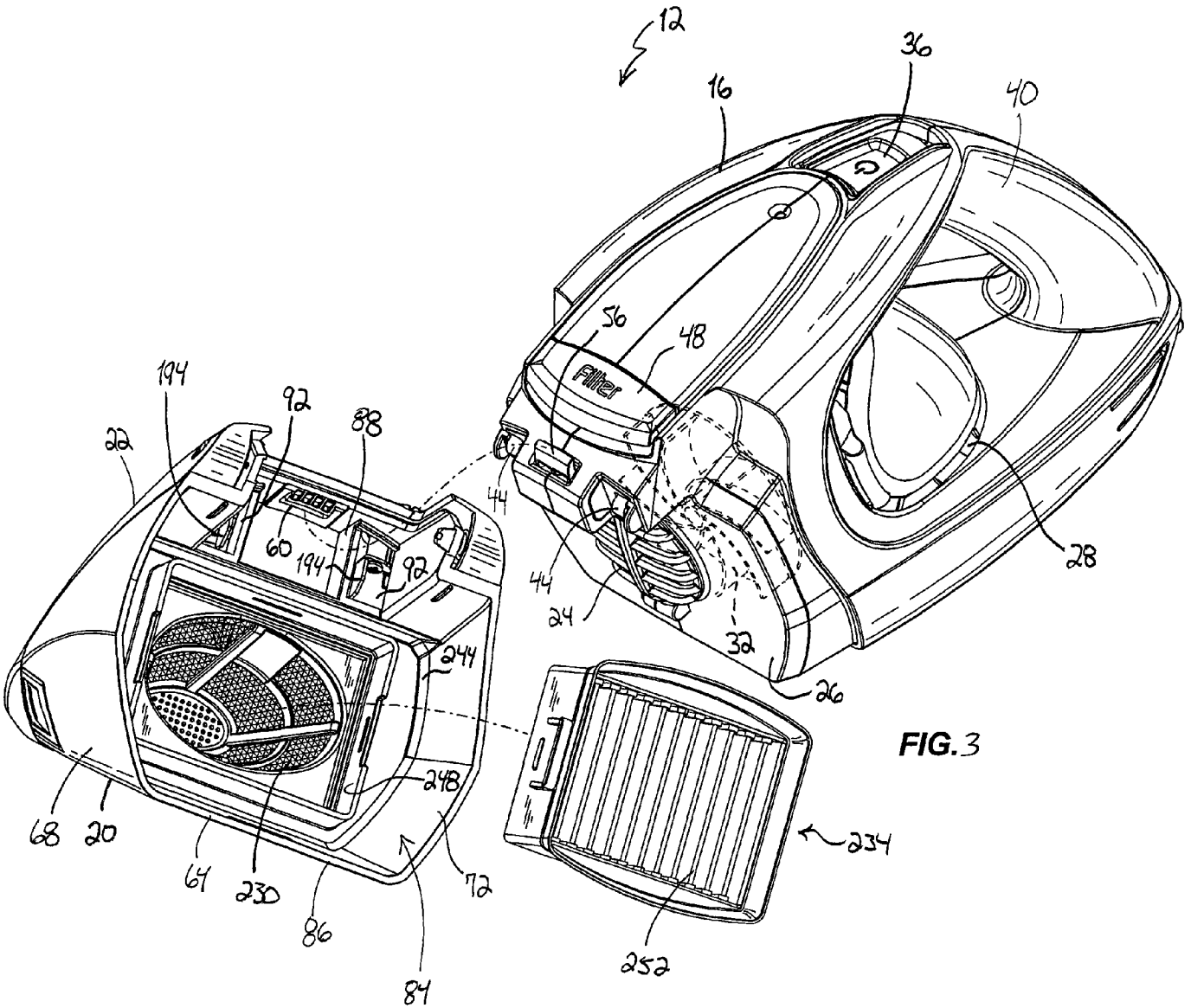
FIG. 3 is a partially exploded view of the vacuum cleaner of FIG. 1.

Referring to FIG. 3, electrical contacts 44 and a release latch 48 are located near the front end 26 of the fan housing 16. The electrical contacts 44 are used to provide electrical power to an accessory tool 52 (FIG. 2) of the vacuum cleaner 12, which will be discussed in more detail below. The release latch 48 includes a projection 56, and the release latch 48 can be pressed by the user to retract the projection 56 within the housing 16 to uncouple the dust cup 20 from the housing 16. The projection 56 is received within an aperture 60 of the dust cup 20 to couple the dust cup 20 and the housing 16. In the illustrated embodiment, the projection 56 is configured to contact the dust cup 20 when the dust cup 20 is being coupled to the housing 16 so that the projection 56 is automatically retracted, which allows the user to reconnect the housing 16 and dust cup 20 without pressing the release latch 48.

Figure 4:
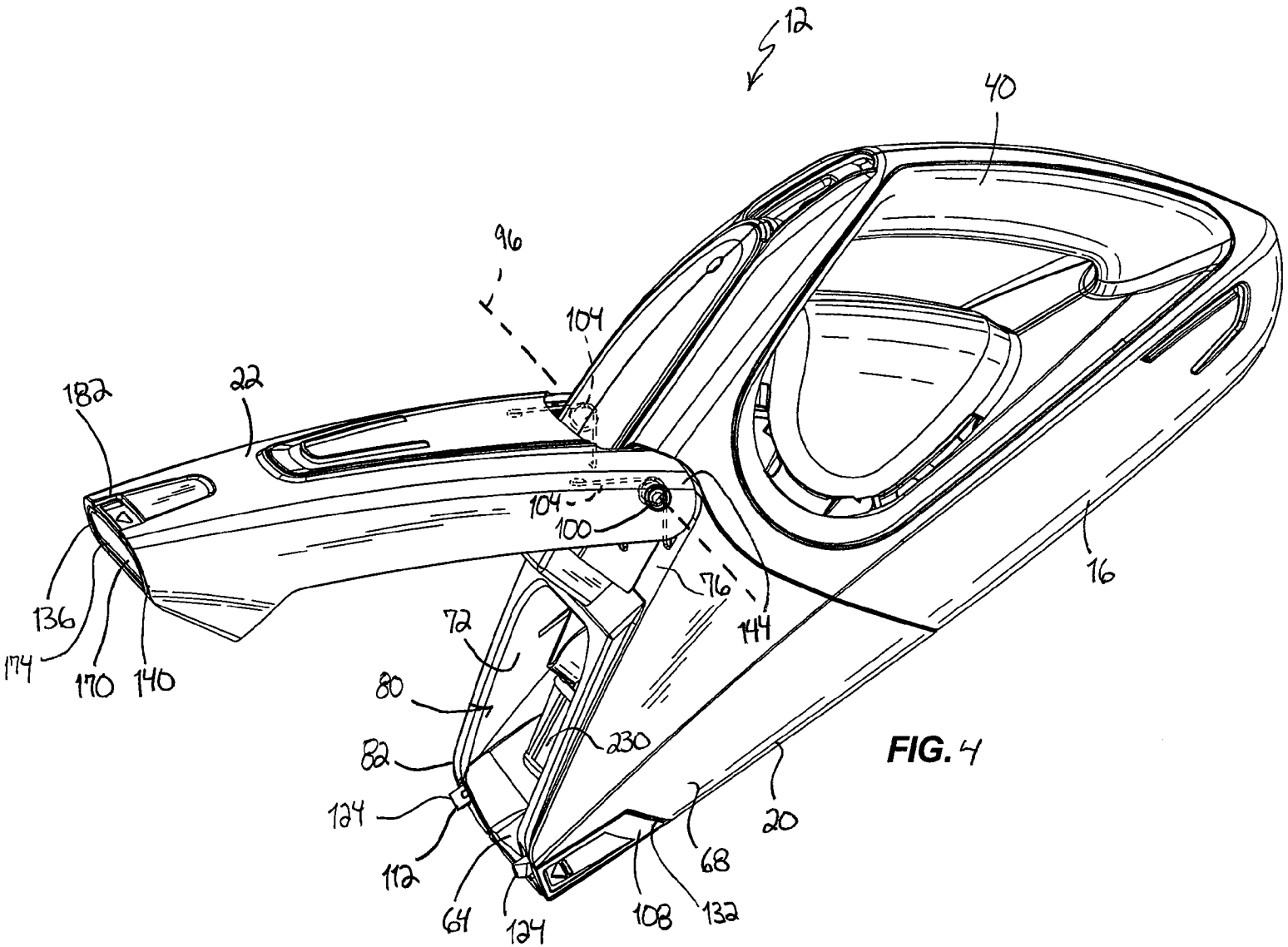
FIG. 4 is a perspective view of the vacuum cleaner of FIG. 1 with the accessory tool removed and a door in an open portion.

Referring to FIG. 4, the dust cup 20 includes a bottom wall 64, a first side wall 68 that extends upwardly from the bottom wall 64, and a second side wall 72 that extends upwardly from the bottom wall 64 opposite the first side wall 68. A top wall 76 extends between the side walls 68 and 72 opposite the bottom wall 64. A front aperture 80 of the dust cup 20 is formed through the top wall 76 at a front end 82 of the dust cup and a rear aperture 84 (FIG. 3) is defined by the walls 64, 68, 72, and 76 at a rear end 86 of the dust cup 20. Referring to FIG. 3, the illustrated dust cup 20 further includes an electrical contact guard 88 that extends upwardly from the top wall 76. The contact guard 88 includes apertures 92 that receive the electrical contacts 44 of the housing 16 to protect the contacts 44 from debris collected within the dust cup 20. In the illustrated embodiment, the walls 64, 68, 72, 76 and the contact guard 88 are integrally formed as a single component from plastic.

Referring to FIG. 4, the illustrated door 22 is pivotally coupled to the dust cup 20 adjacent the top wall 76 such that the door 22 opens upwardly by pivoting about an axis 96. The illustrated door 22 is coupled to the dust cup 20 using rivets 100, but in other embodiments, other suitable types of fasteners can be used to pivotally couple the door 22 to the dust cup 20. Biasing members 104, which are torsion springs in the illustrated embodiment, are located around each of the rivets 100 between the dust cup 20 and the door 22 to bias the door upwardly and toward the open position.

Figure 6:
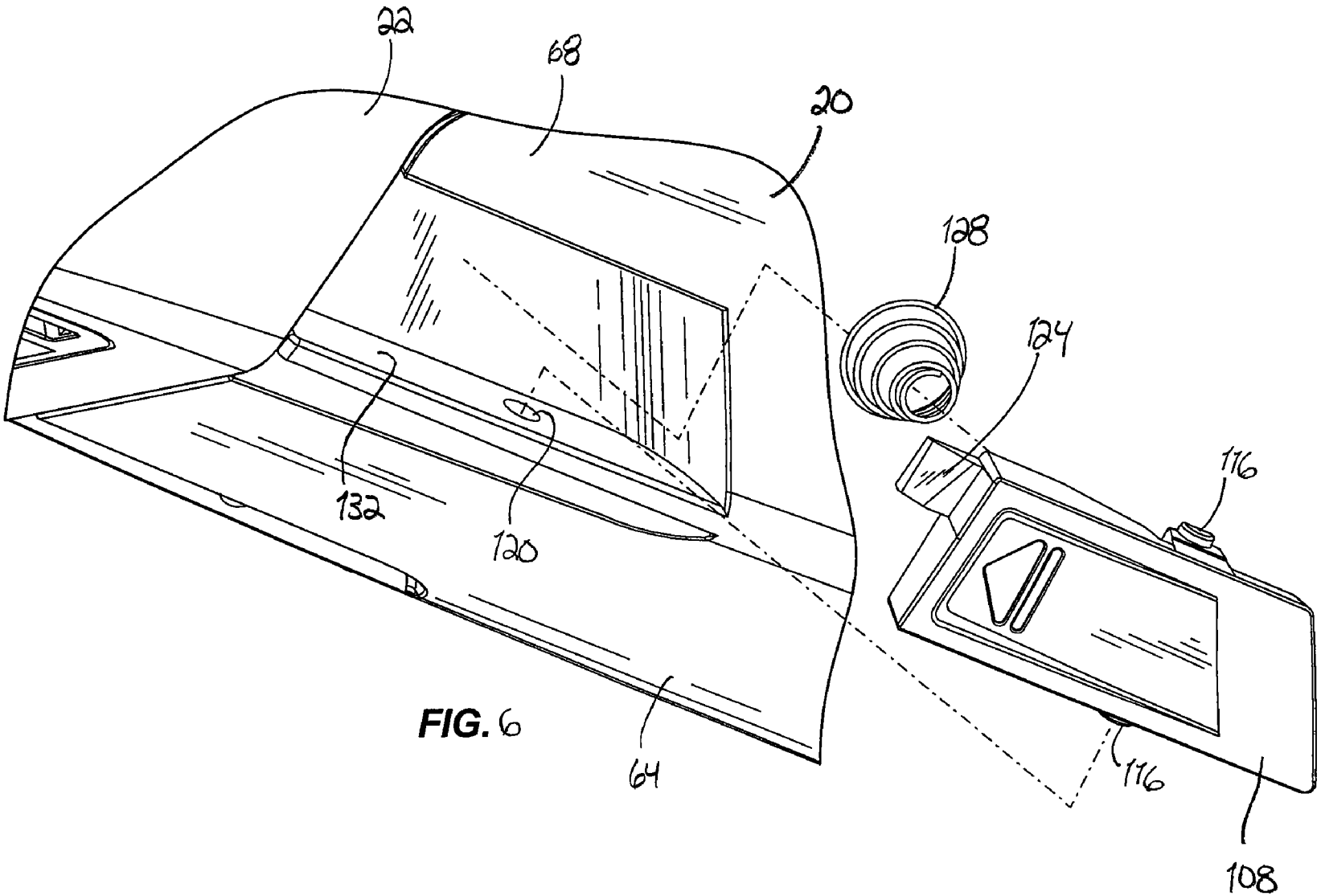
FIG. 6 is an enlarged partially exploded view of the vacuum cleaner of FIG. 1 illustrating a door latch assembly.

With continued reference to FIG. 4, the vacuum cleaner 12 further includes a first latch 108 and a second latch 112 that retain the door 22 in the closed position against the bias of the biasing members 104. The first latch 108 and the second latch 112 are substantially the same, and therefore, only the first latch 108 will be described in detail and like components have been given the same reference number. Referring to FIG. 6, the latch 108 includes posts 116 that are received within post receiving apertures 120 formed in the dust cup 20 to pivotally couple the latch 108 to the dust cup 20. The latch 108 further includes a projection 124 that engages the door 22 when the latch 108 is in an engaged position in order to hold the door 22 in the closed position. A biasing member 128, which is a coil spring in the illustrated construction, is located between the latch 108 and the dust cup 20 to bias the latch 108 into the engaged position. The user presses the latch 108 (the user similarly presses the second latch 112) against the bias of the spring 128 to pivot the latch 108 to a disengaged position where the projection 124 no longer retains the door 22 in the closed position and the torsion springs 104 (FIG. 4) move the door 22 toward the open position.

With continued reference to FIGS. 4 and 6, the latches 108 and 112 are coupled to the dust cup 20 within an aperture or recess 132 formed in the respective side walls 68 and 72 of the dust cup 20. The recesses 132 and latches 108 and 112 are sized such that the latches 108 and 112 are flush with the respective side walls 68 and 72 when the latches 108 and 112 are in the engaged position.

Figure 7:
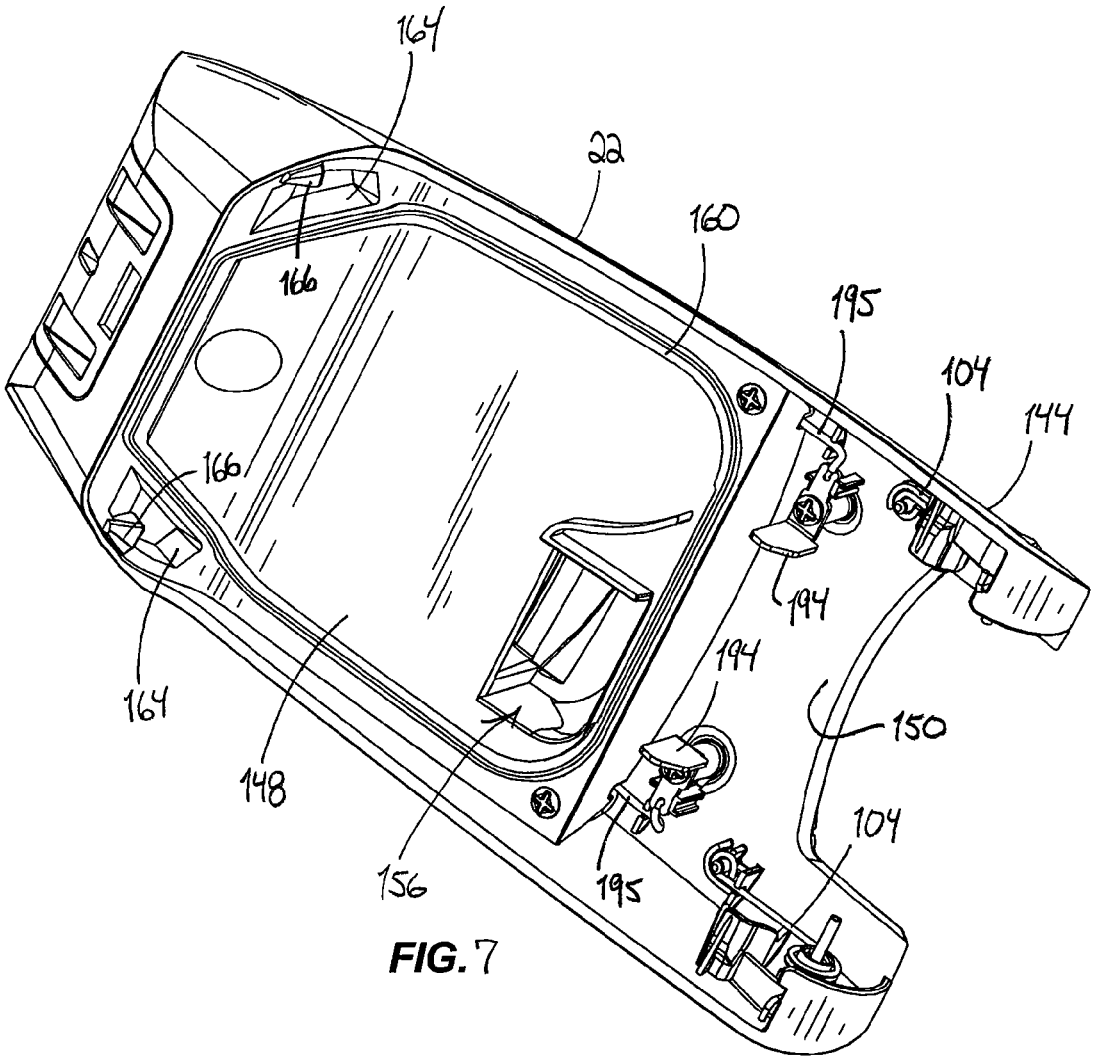
FIG. 7 is a perspective view of an underside of the door of the vacuum cleaner of FIG. 1.
Figure 10:
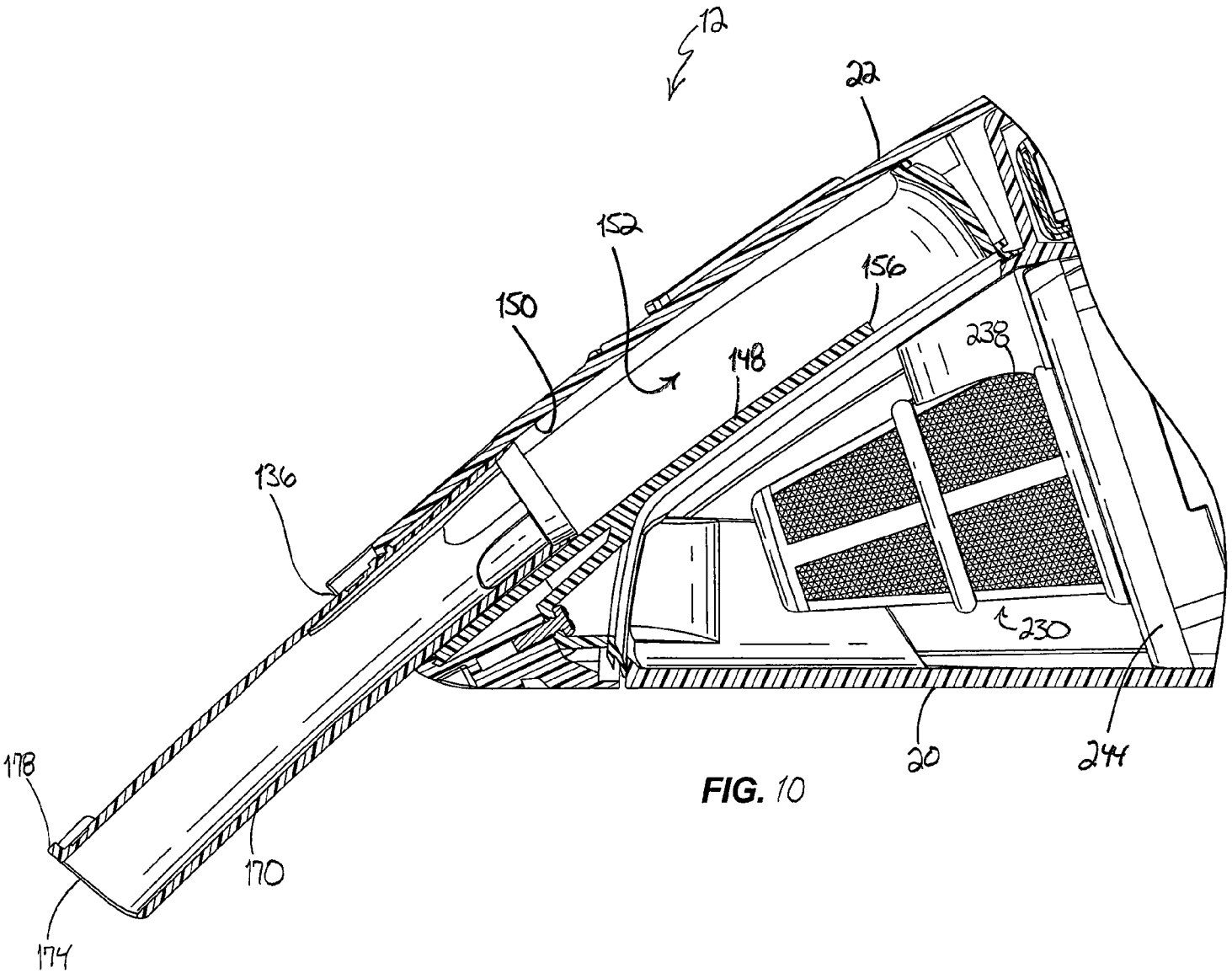
FIG. 10 is a partial cross-sectional view of the vacuum cleaner of FIG. 1 taken along line 10-10 of FIG. 5 illustrating the telescoping nozzle in the extended position.

Referring to FIGS. 2 and 4, the door 22 includes an inlet aperture 136 located through a front end portion 140 of the door 22 opposite a rear end portion 144 of the door 22 where the door 22 is pivotally coupled to the dust cup 20. As best seen in FIGS. 7 and 10, a cover 148 is coupled to an underside 150 of the door 22 to define an inlet passageway 152 between the cover 148 and the door 22. The inlet passageway 152 provides fluid communication between the inlet aperture 136 and the dust cup 20. An outlet aperture 156 is located through a rear portion of the cover 148 to provide fluid communication between the dust cup 20 and the inlet passageway 152. A rubber seal 160 is coupled to the cover 148 to seal the interface between the cover 148 and the dust cup 20 around the periphery of the aperture 80 (FIG. 4) when the door 22 is in the closed position. Also, the cover 148 includes apertures 164 (FIG. 7) that receive the projections 124 (FIG. 4) of the latches 108 and 112 when the door 22 is in the closed position to retain the door 22 in the closed position. The apertures 164 each include a cam surface 166 that is configured to contact the projections 124 of the latches 108 and 112 to automatically move the latches 108 and 112 when the user closes the door 22 such that the door 22 can be closed and retained in the closed position without the user having to directly operate or actuate the latches 108 and 112.

Figure 5:
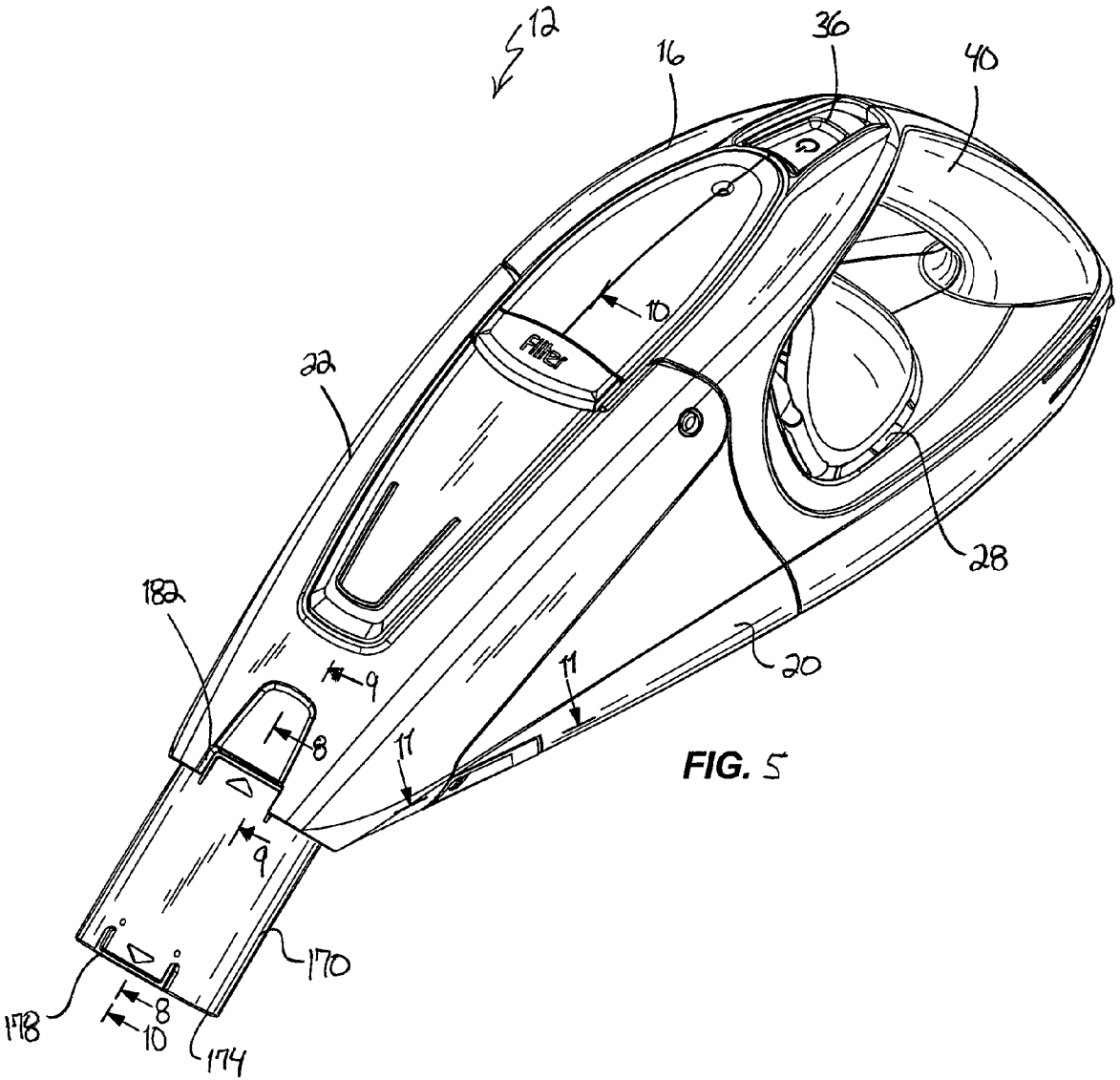
FIG. 5 is a perspective view of the vacuum cleaner of FIG. 1 with the accessory tool removed, the door in a closed position, and a telescoping nozzle in an extended position.
Figure 8:
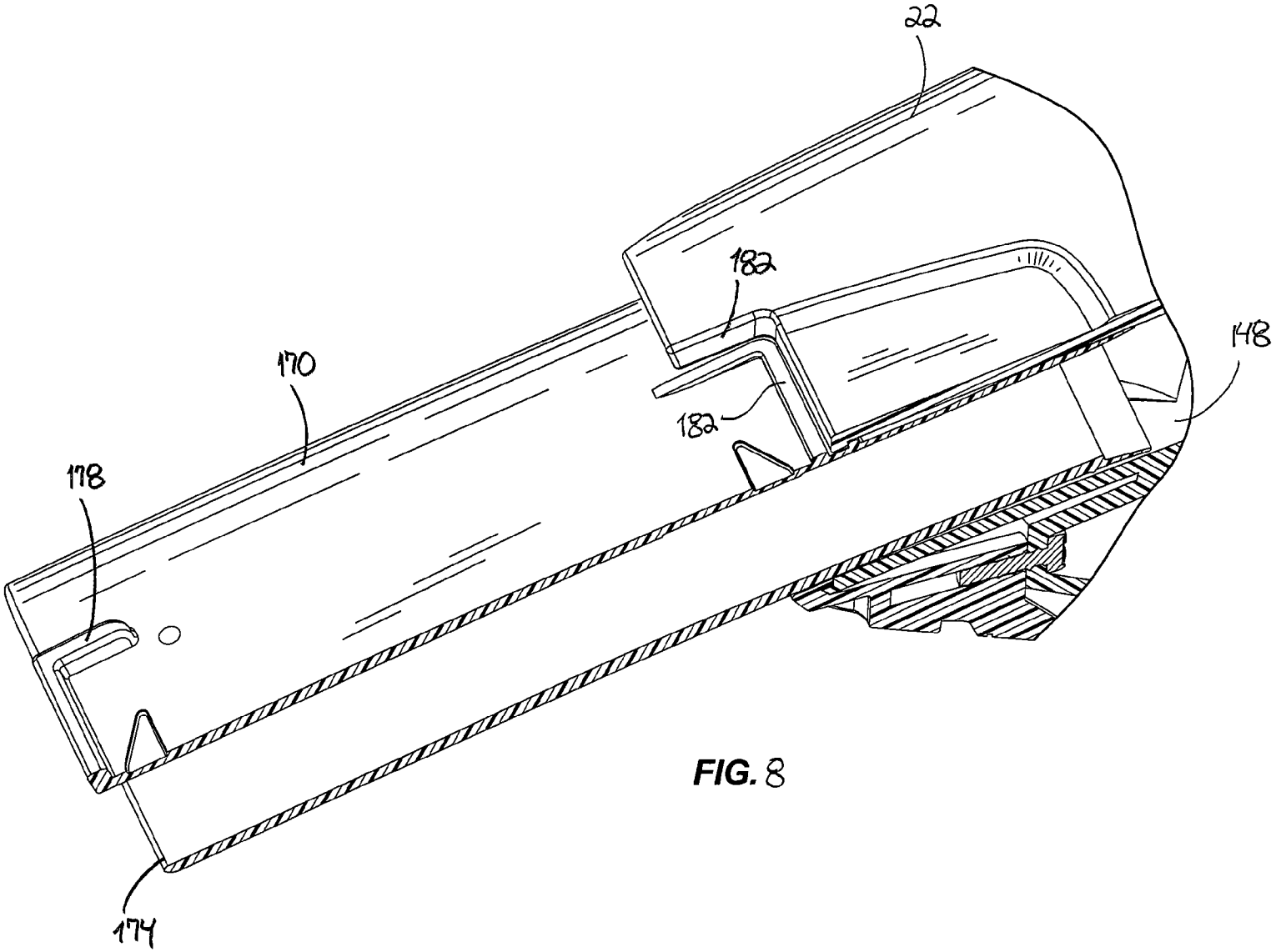
FIG. 8 is a partial cross-sectional view of the vacuum cleaner of FIG. 1 taken along line 8-8 of FIG. 5 illustrating the telescoping nozzle in the extended position.
Figure 9:
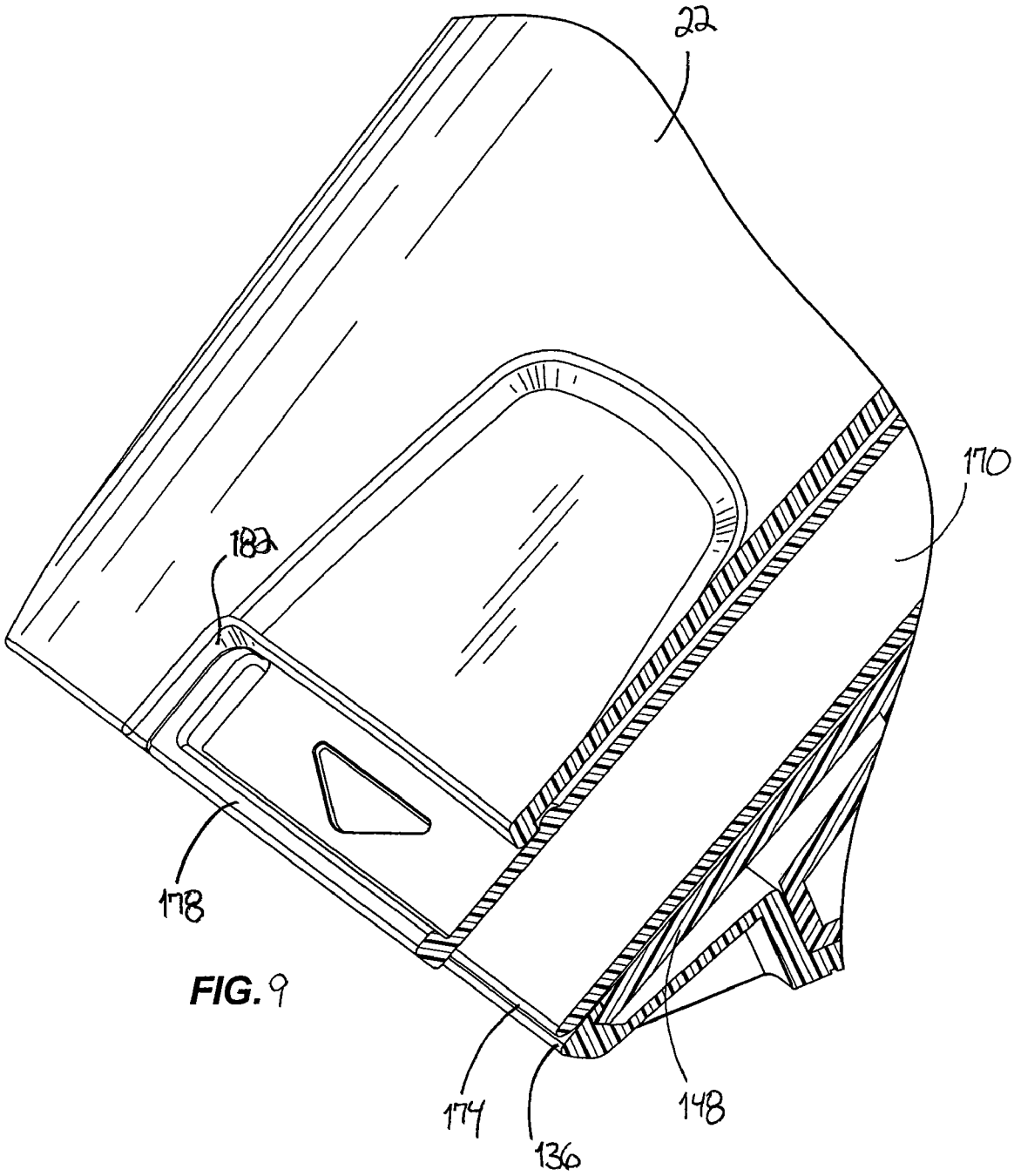
FIG. 9 is a partial cross-sectional view of the vacuum cleaner of FIG. 1 taken along line 9-9 of FIG. 5 illustrating the telescoping nozzle in a recessed position.

Referring to FIGS. 5 and 10, the illustrated vacuum cleaner 12 includes a telescoping nozzle 170 in fluid communication with the inlet passageway 152 and movably coupled to the door 22 so that the nozzle 170 can be slid by the user between an extended position (FIG. 5) and a retracted or recessed position (FIG. 4). The nozzle 170 includes an inlet aperture 174 that provides fluid communication into the nozzle 170 and the inlet passageway 152. The nozzle 170 further includes a grip 178 formed by an upstanding wall that provides the user with a place to grip the nozzle 170 to move the nozzle 170 between the extended and the retracted positions. A cutout 182 of the door 22 receives the grip 178 when the nozzle 170 is in the retracted position. Referring to FIGS. 5 and 8, the nozzle 170 further includes a tab 186. The tab 186 is integrally formed with the nozzle 170 as a single component. The tab 186 engages the cutout 182 when the nozzle 170 is in the extended position to retain the nozzle 170 in the extended position. The user presses downwardly on the tab 186 to disengage the tab 186 and the cutout 182 of the door 22 to slid the nozzle 170 back into the recessed position.

Referring to FIG. 2, the illustrated vacuum cleaner 12 includes the accessory tool 52. The illustrated door 22 includes terminal apertures 188 located adjacent the front end portion 140 of the door 22. Electrical contacts 190 are located within the terminal apertures 188 and the electrical contacts 190 are electrically coupled to electrical contacts 194 (FIG. 7) using wires 195. The electrical contacts 194 are coupled to the underside 150 of the door 22 near the rear end 144 of the door 22, and the electrical contacts 194 engage the electrical contacts 44 (FIG. 3) of the housing 16 when the door 22 is in the closed position in order to provide electrical power to the terminals 190 within apertures 188 when the vacuum cleaner is turned 'on.'

Referring to FIG. 2, the accessory tool 52 includes an outlet conduit 204 and a pair of terminals 208 that are located near the conduit 204. A tab 212 is located between the terminals 208. To couple the accessory tool 52 to the vacuum cleaner 12, the conduit 204 is inserted within the inlet aperture 174 of the telescoping nozzle 170. With the nozzle 170 in the retracted position (FIG. 2), the terminals 208 of the tool 52 are received within the terminal apertures 188 of the door 22, which electrically couples a motor of the accessory tool 52 with a power supply of the vacuum cleaner 12. Although, the illustrated accessory tool 52 includes terminals 208 for an electric motor, in other embodiments, the accessory tool can be driven by an air turbine, and in yet other embodiments, the accessory tool may not include a drive member such as the motor or the air turbine.

With continued reference to FIG. 2, when the accessory tool 52 is connected to the vacuum cleaner 12, the tab 212 of the accessory tool 52 is received within a recess 218 of the door 22. The tab 212 engages the recess 218 couple the tool 52 to the vacuum cleaner 12, especially when the tool 52 is pulled along a work surface in the direction of arrow 222 of FIG. 1 to inhibit the conduit 204 from being pulled out of the nozzle 170.

Referring to FIGS. 1 and 2, to remove the accessory tool 52 from the vacuum cleaner 12, the user rotates the accessory tool 52 slightly to disengage the tab 212 and the recess 218. Then, the user pulls the accessory tool 52 to pull the conduit 204 of the tool 52 out of the nozzle 170. In the illustrated embodiment, the friction between the nozzle 170 and the door 22 is greater than the friction between the conduit 204 and the nozzle 170 so that the nozzle 170 remains in the recessed position (FIGS. 1 and 2) when the user removes the tool 52 and removing the tool 52 does not cause the nozzle 170 to be pulled to the extended position. In other embodiments, a mechanical lock can be used to hold the nozzle 170 is the recessed position when the user removes the accessory tool 52 from the nozzle 170.

Referring to FIGS. 3 and 10, the vacuum cleaner 12 further includes a first filter 230 and a second filter 234. The first filter 230 includes a wire screen 238, a seal 244, and a rear aperture 248. The second filter 234 includes pleated filter media 252. The second filter 234 is received within the rear aperture 248 of the first filter 230 to couple the first filter 230 and the second filter 234. Together the first filter 230 and the second filter 234 are positioned within the dust cup 20 through the rear aperture 84. The seal 244 seals the periphery of the first filter 230 and the walls 64, 68, 72, and 76 of the dust cup 20 so that air traveling through the dust cup 20 generally flows through the first filter 230 and then through the second filter 234 without bypassing the filters 230 and 234.

Referring to FIGS. 3, 5, and 10, in operation, the user grabs the handle 40 of the vacuum cleaner 12 and slides the switch 36 to the 'on' position which causes the fan 32 (FIG. 3) to generate a vacuum within the dust cup 20. Accordingly, air and debris are drawn through the inlet aperture 136 of the door 22 (or through inlet 174 of the nozzle 170 in the illustrated embodiment) and into the inlet passageway 152. The air and debris travel through the inlet passageway 152 and through the outlet aperture 156 of the cover 148 and into the dust cup 20. The relatively heavy debris falls to the bottom of the dust cup 20 while the relatively light debris continues to travel with the air flow. The relatively light and coarse debris is filtered by the first filter or screen 230. Then, the relatively light and fine debris is filtered by the pleated filter media 252 of the second filter 234. The clean filtered air is then drawn through the inlet 24 (FIG. 3) of the fan housing 16 by the fan 32 and discharged from the vacuum cleaner 12 through the outlet 28.

Figure 11:
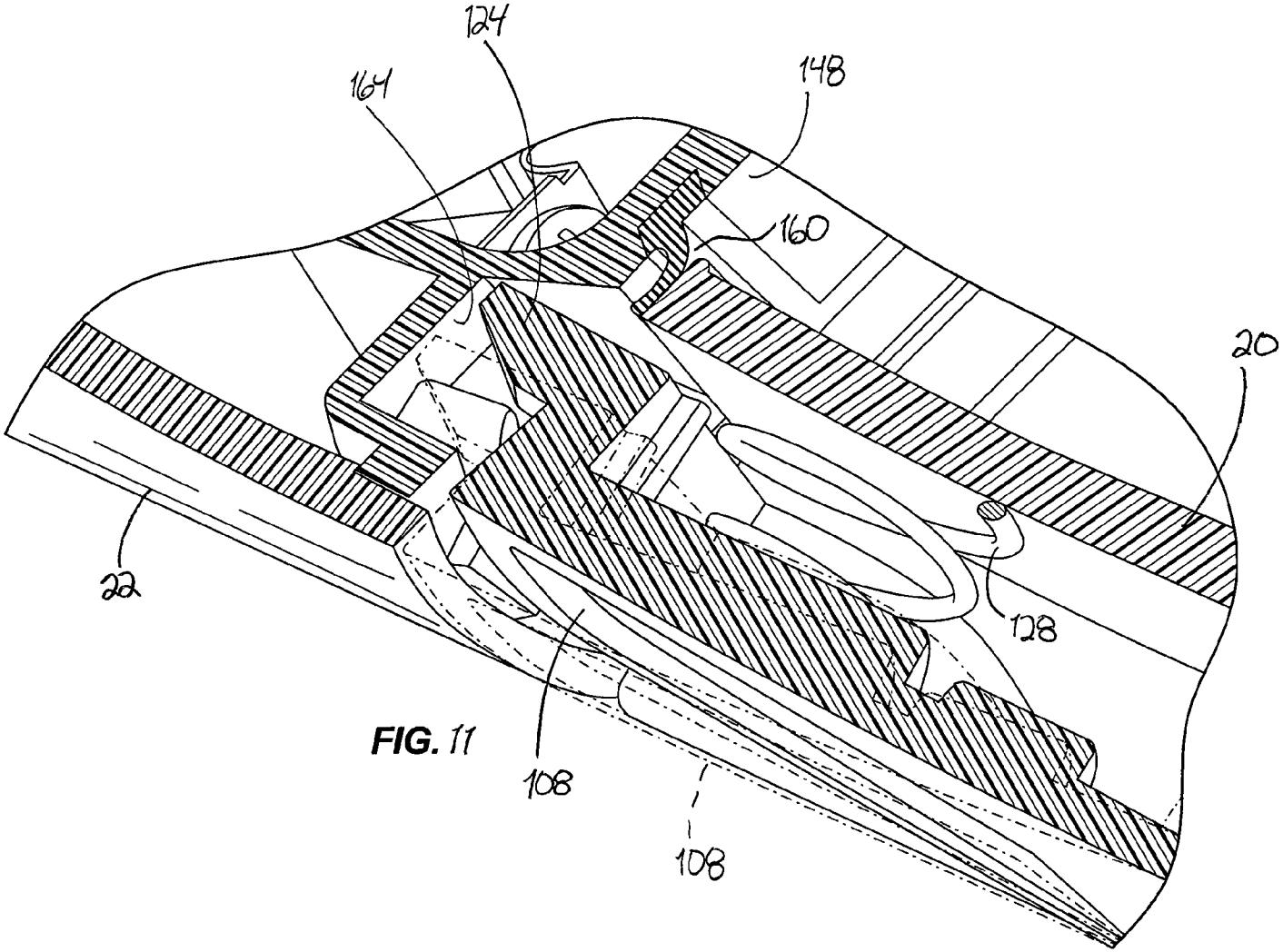
FIG. 11 is a partial cross-sectional view of the door latch assembly of the vacuum cleaner of FIG. 1 taken along line 11-11 of FIG. 5.

Referring to FIGS. 4 and 11, if the user desires to empty the dust cup 20, the user presses the latches 108 and 112 to move the latches 108 and 112 to the disengaged position (represented by dashed lines 108 of FIG. 11) which causes the springs 104 to pivot the door 22 about the axis 96 upwardly and toward the open position. Then, the user tilts the front end of the dust cup 20 down to empty debris through the front aperture 80 of the dust cup 20. Meanwhile, the door 22 is held open by the spring 104 and the user does not have to hold the door 22 open, which leaves the user a free hand to facilitate emptying an cleaning the vacuum cleaner 12. Also, as visible in FIG. 4, the upwardly opening door 22, which includes the nozzle 170 coupled to the door 22, provides a relatively clear passageway through the front aperture 80 of the dust cup 20 to allow for easy emptying of the dust cup 20 through the aperture 80. With the door 22 in the open position, aperture 80 also provides the user with access to the first filter 230 so that the user can clean the filter 230 if necessary. The user can close the door 22, as discussed above, to resume cleaning. Alternatively, referring to FIG. 3, the user can empty the dust cup 20 through the rear aperture 84. The user can press the release latch 48, which retracts the projection 56 to with drawn the projection 56 from the aperture 60, to uncouple the dust cup 20 from the housing 16. Then, the user can remove the filters 230 and 234 through the rear aperture 84 to clean the filters and empty debris through the rear aperture 84 of the dust cup 20.

Various features and advantages of the invention are set forth in the following claims.

What is claimed is:

1. A handheld vacuum cleaner comprising:

an inlet;

an outlet;

a dust cup including an aperture, the dust cup in fluid communication with the inlet and the outlet and configured to retain debris collected by the handheld vacuum cleaner;

a fan configured to draw air through the inlet and the dust cup and to discharge air through the outlet;

a door adjacent to the dust cup and including the inlet, the door movable between an open position to allow a user to empty the debris collected within the dust cup through the aperture of the dust cup and a closed position to inhibit debris from being emptied through the aperture of the dust cup and to allow debris to be collected through the inlet and through the aperture of the dust cup; and a biasing member configured to bias the door toward the open position.

2. The handheld vacuum cleaner of claim 1, wherein the door is pivotally coupled to the dust cup such that the door is configured to pivot between the open position and the closed position so that the door remains coupled to the dust cup when the door is in the open position.

3. The handheld vacuum cleaner of claim 1, further comprising a latch configured to move between an engaged position and a released position, wherein the latch engages the door in the engaged position to retain the door in the closed position, and wherein the latch is movable to the released position to allow the biasing member to move the door toward the open position.

4. The handheld vacuum cleaner of claim 3, wherein the dust cup includes a recess, and wherein the latch is at least partially received within the recess of the dust cup.

5. The handheld vacuum cleaner of claim 4, wherein the latch includes a post, and wherein the dust cup includes a post aperture that receives the post of the latch to pivotally couple the latch to the dust cup.

6. The handheld vacuum cleaner of claim 5, further comprising a spring coupled to the dust cup and the latch and configured to bias the latch toward the engaged position.

7. The handheld vacuum cleaner of claim 3, wherein the dust cup includes a bottom wall, a first side wall that extends upwardly from the bottom wall, and a second side wall that extends upwardly from the bottom wall, wherein the latch is a first latch coupled to the first side wall, the handheld vacuum cleaner further comprising a second latch coupled to the second side wall and configured to move between an engaged position and a released position, wherein the second latch engages the door in the engaged position to retain the door in the closed position, and wherein the second latch is movable to the released position to allow the biasing member to move the door toward the open position.

8. The handheld vacuum cleaner of claim 1, further comprising a cover coupled to the door for movement with the door when the door moves between the open position and the closed position, wherein the cover and the door together define an inlet passageway that provides fluid communication between the inlet and the dust cup, and wherein the cover includes a passageway outlet to provide fluid communication from the inlet passageway into the dust cup.

9. The handheld vacuum cleaner of claim 8, wherein the cover includes a seal configured to seal an interface between the dust cup and the cover adjacent the aperture of the dust cup when the door is in the closed position.

10. The handheld vacuum cleaner of claim 1, further comprising a telescoping nozzle that defines the inlet, wherein the telescoping nozzle is movably coupled to the door such that the telescoping nozzle is movable from a recessed position where the telescoping nozzle is substantially retained within the door to an extended position where the telescoping nozzle extends from the door to position the inlet further from the dust cup.

11. The handheld vacuum cleaner of claim 10, wherein the telescoping nozzle includes a tab formed with the telescoping nozzle as a single component, wherein the tab is configured to engage the cover to releaseably retain the telescoping nozzle in the extended position.

12. The handheld vacuum cleaner of claim 1, further comprising a fan housing coupled to the dust cup and the door, wherein the fan is disposed within the fan housing, the handheld vacuum cleaner further comprising a fan housing latch configured to removably couple the fan housing to the dust cup and the door.

13. The handheld vacuum cleaner of claim 12, wherein the door is movable between the open position and the closed position while the fan housing remains coupled to the dust cup and the door.

14. The handheld vacuum cleaner of claim 12, further comprising a handle coupled to the fan housing, the handle configured to be grasped by a user to move the handheld vacuum cleaner during operation.

15. The handheld vacuum cleaner of claim 1, further comprising, a first filter disposed within the dust cup configured to filter air that travels from the inlet toward the outlet, the first filter including an aperture; and a second filter disposed within the dust cup configured to filter air that travels from the first filter toward the outlet, the second filter received within the aperture of the first filter to couple the first filter and the second filter.

16. The handheld vacuum of claim 15, wherein the first filter includes a wire screen, and wherein the second filter includes a pleated filter.

* * * * *